US005197251A

United States Patent [19]

Krysak

[11] Patent Number: 5,197,251

[45] Date of Patent: Mar. 30, 1993

[54] INSULATION PROTECTION SYSTEM

[76] Inventor: Jerry J. Krysak, 1723 N. 27th Pl., Sheboygan, Wis. 53081

[21] Appl. No.: 294,355

[22] Filed: Jan. 9, 1989

[51] Int. Cl.[5] ..... E04B 1/62

[52] U.S. Cl. ..... 52/407; 182/222

[58] Field of Search ..... 52/406, 407, 299, 126.6, 52/126.5; 182/222

[56] References Cited

U.S. PATENT DOCUMENTS 4,631,878 12/1986 Laramore ..... 52/126.6

*Primary Examiner*—Michael Safavi

*Attorney, Agent, or Firm*—C. Thomas Sylke

[57] ABSTRACT

An insulation protection system has a number of pairs of upright members between which insulation may be laid. After the installation has been installed, a crossbar is mounted between and to each pair of upright members. Support surfaces may then be mounted or placed on the crossbars, providing storage space above the insulation without damage to the insulation. In a preferred embodiment of the present invention, low cost plastic may be used to provide adequate support for the support surface.

6 Claims, 2 Drawing Sheets

INSULATION PROTECTION SYSTEM

BACKGROUND OF THE INVENTION

1. Field of the Invention

The present invention relates generally to the art of storage systems. More particularly, the present invention relates to a storage system which accommodates and protects insulation.

2. Description of Related Art

In recent years, many people have installed new or supplemental insulation in storage areas such as attics and crawl spaces to enhance the energy use of their homes and other buildings. Typically, when such insulation has been placed on the floor of a storage space, use as a storage area has been lost. Walking on or setting objects on the insulation can severely impair the R factor (or insulation capability) of the insulation. When storage space is necessary, many people have simply left specific areas uninsulated to be able to store material thereon.

To date, no one has developed a system which ensures protection of the insulation while still utilizing the storage space in the given area. A system which overcomes the above-mentioned shortcomings of earlier practices would represent a significant advancement in the art.

OBJECTS AND SUMMARY OF THE INVENTION

It is the primary object of the present invention to provide an insulation protection system which provides complete protection of insulation without damage or impairment of insulating efficiency.

It is a further object of the present invention to provide an insulation protection system which permits complete insulation of a given storage area while also maintaining nearly total availability of the space therein for storage of various items.

It is yet another object of the present invention to provide an insulation protection system which is economical to produce and easy to install.

How these and other objects and advantages of the present invention are accomplished will become apparent to one presently of ordinary skill in the art after reading the following description of the preferred embodiment in conjunction with the FIGURES. Generally, however, the objects are accomplished in an insulation protection system having a number of pairs of upright members between which insulation may be laid. After the insulation has been installed, a crossbar is mounted between and to each pair of upright members. Support surfaces may then be mounted or placed on the crossbars, providing storage space above the insulation without damage to the insulation. In the preferred embodiment of the present invention, low cost plastic may be used to provide adequate support for the support surface.

While other modifications, additions and applications may become obvious to one of ordinary skill in the art, the scope of the invention is to be defined solely by the scope of the claims herein.

DESCRIPTION OF THE DRAWINGS

In the FIGURES, like reference numerals are used to indicate like components.

DETAILED DESCRIPTION OF THE PREFERRED EMBODIMENT

General Construction

Figure 1:
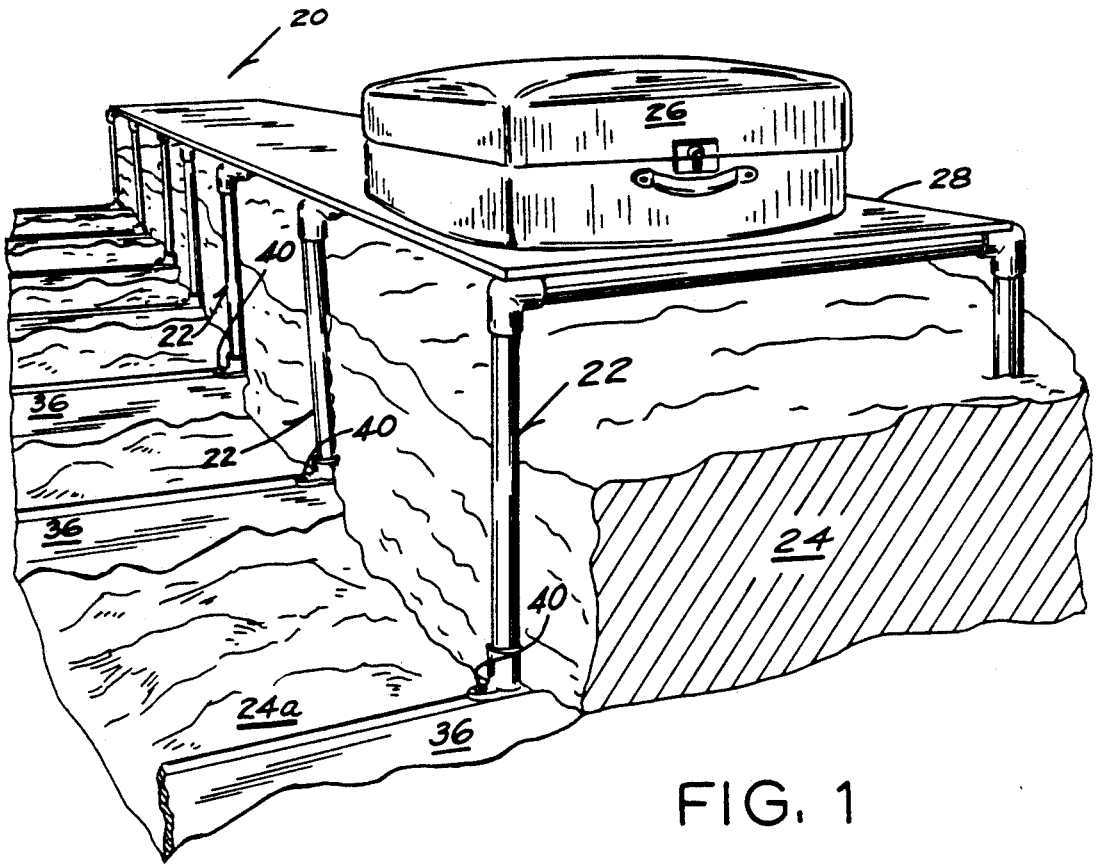
FIG. 1 is a perspective view of the present invention.

An insulation protection system 20 is shown in FIG. 1. A number of support units 22 straddle insulation 24 while also supporting various items such as luggage 26. The luggage 26 actually rests on a support platform 28 which is in turn supported by units 22.

Figure 5:
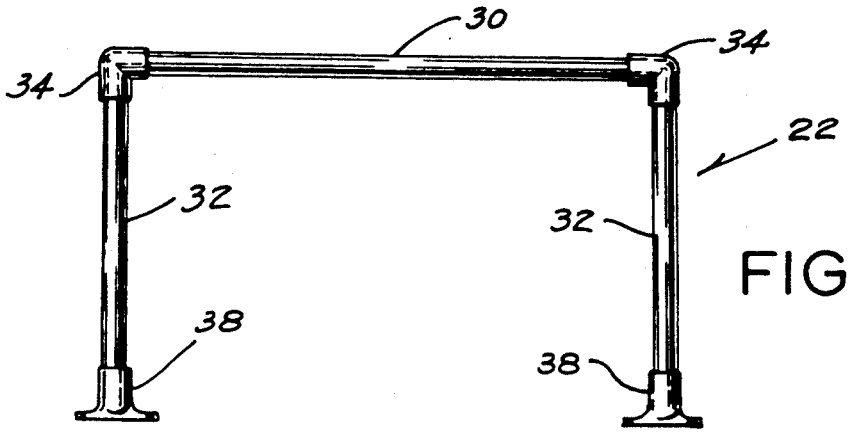
FIG. 5 is a plan view of an individual support unit of the present invention.

As seen in FIG. 5, each support unit 22 consists of a crossbar 30 which is connected to a pair of upright members 32 by elbow pieces 34. Upright members 32 are secured to a floor joist 36 by means of brackets 38 anchored to joists 36 with screws 40.

Support surface 28 be secured to support units 22 by screws (not shown), or may rest on top of a number of units 22. The proportions of each support unit 22 and support surface 28 are dependent upon the size and type of insulation used, as well as the weight characteristics of the items to be placed on top of surface 28. Additionally, in the preferred embodiment, support units 22 are made of a lightweight, inexpensive plastic material. However, other materials may be used depending on the performance requirements of the system.

Installation

Figure 2:
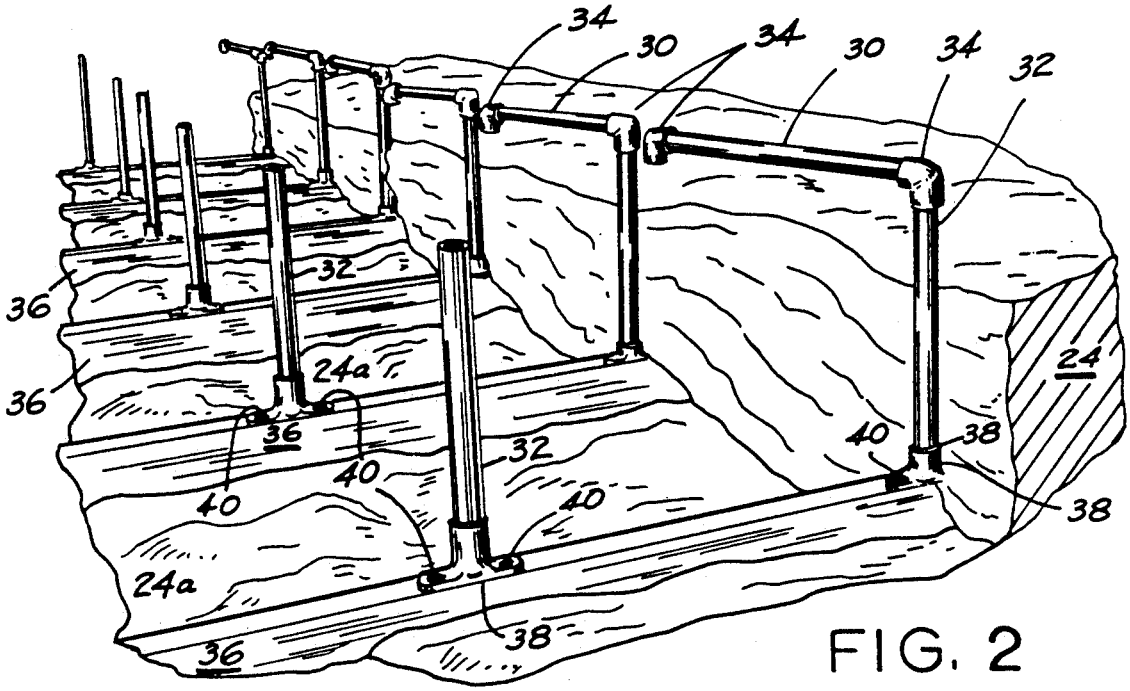
FIG. 2 is a perspective view of the present invention prior to installation of insulation.
Figure 3:
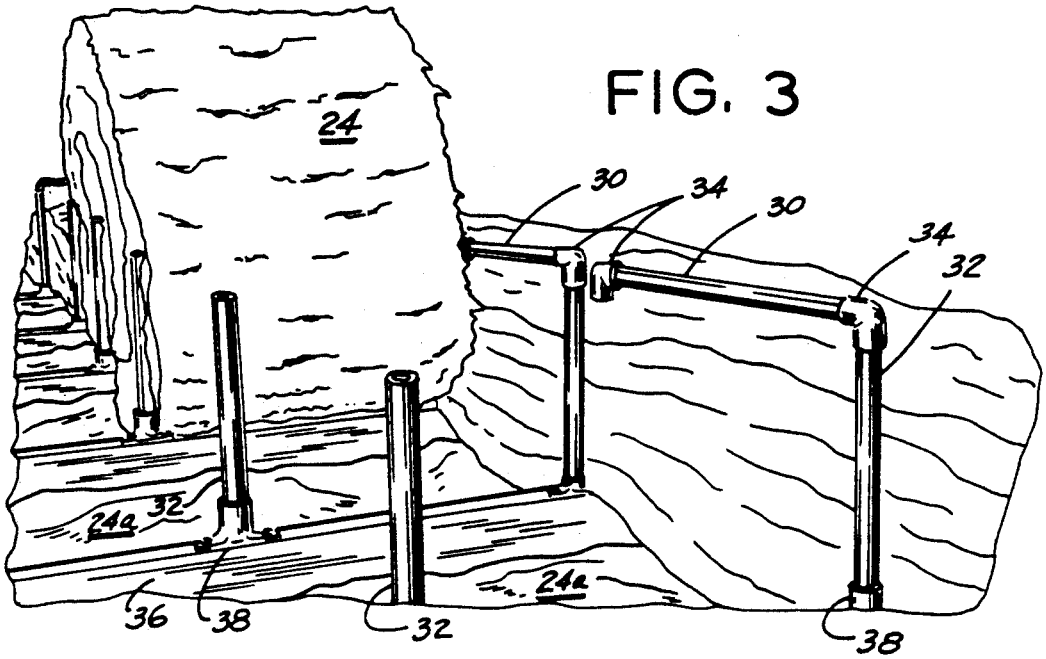
FIG. 3 is a perspective view of insulation being installed.
Figure 4:
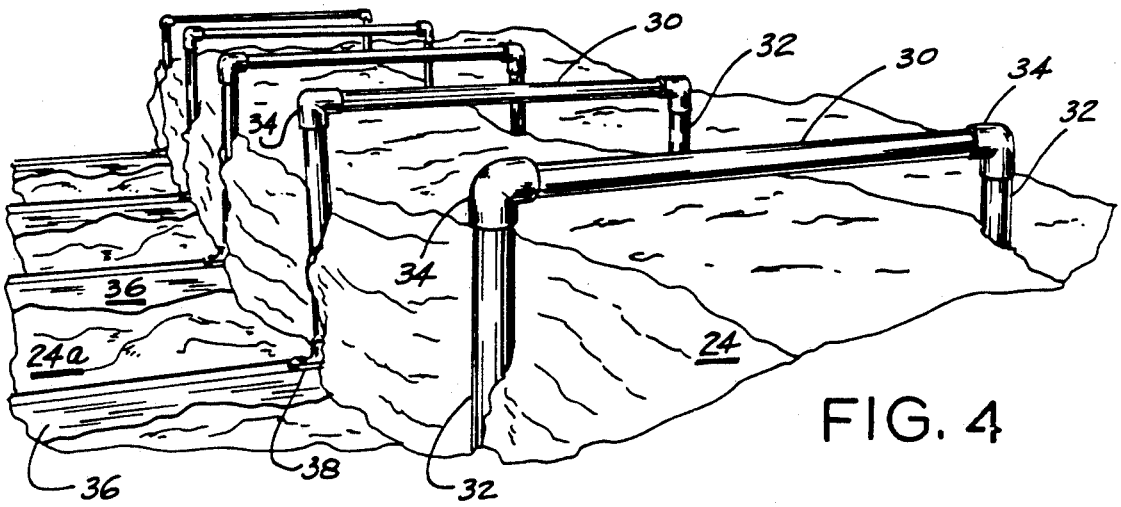
FIG. 4 is a perspective view of the present invention after insulation has been installed and the support units have been completely erected.

FIGS. 2 through 4 illustrate installation of the present protection system in a room having a number of floor joists 36 and an existing layer of insulation 24*a*. A number of pairs of brackets 38 are anchored to joists 36 at a separation which will accommodate a given roll of insulation 24. A vertical support member is inserted into each bracket 38, each member 32 being long enough to provide adequate clearance between support surface 28 and the insulation 24. The crossbar 30 and pair of elbow brackets 34 are attached to one of each pair of vertical members 32 but rotated 90° so that the insulation may be rolled without interference from the crossbar 30.

Insulation 24 is then rolled between pairs of vertical members 32. After the insulation 24 has been laid out, crossbars 30 are rotated 90° again so that each elbow bracket 34 engages a vertical member as well as crossbar 30. Support surface 28 may then be placed on top of the support units 22. If desired, the support surface 28 may be anchored in some way to the support units 22.

After reading the above description, additions, modifications and applications of the protection system will become obvious to one of ordinary skill in the art and may be made without departing from the spirit and scope of the present invention. Therefore, the above illustrated and described preferred embodiment is illustrative rather than limiting, the scope of the invention being limited only by the claims that follow.

What is claimed is:

1. A system for protecting insulation on a base, said system comprising:

a support surface above said base and said insulation;

a plurality of means for supporting said surface, each said supporting means comprising:

first and second vertical tubes secured to said base; and a horizontal tube connecting said vertical tubes.

2. The system according to claim 1 wherein said base is a plurality of floor joists.

3. The system according to claim 2 wherein said vertical and horizontal tubes are made of plastic.

4. The system according to claim 3 wherein said vertical tubes are secured to said joists by screws.

5. The system according to claim 4 wherein each said supporting means is generally an inverted U-shape.

6. A system for protecting insulation placed on a base comprising a plurality of joists, said system comprising:

a support surface above said base and said insulation;

a plurality of units for supporting said surface, each said unit comprising:

first and second vertical tubes each having bottom ends secured to first and second brackets, respectively;

first and second elbow pieces secured to the top ends of said first and second vertical tubes, respectively;

a horizontal tube connecting said elbow pieces; and wherein said brackets are screwed to at least one of said joists.

* * * * *